United States Patent [19]

Coverley

[11] 4,200,950

[45] May 6, 1980

[54] LARGE AREA CLEANING SYSTEM

[76] Inventor: Roger D. Coverley, 11 Eastcliff Dr., Joliet, Ill. 60436

[21] Appl. No.: 898,636

[22] Filed: Apr. 21, 1978

[51] Int. Cl.[2] ..... A47L 9/00

[52] U.S. Cl. ..... 15/314; 15/323; 15/340; 406/39

[58] Field of Search ..... 15/323, 340, 314, 315; 214/82, 83.28, 302

[56] References Cited

U.S. PATENT DOCUMENTS

| | | | |
|---|---|---|---|
| 1,698,180 | 1/1929 | White | 15/314 X |
| 2,574,412 | 11/1951 | Pringle | 15/314 X |
| 2,803,847 | 8/1957 | Hobbs | 15/340 X |
| 3,594,848 | 7/1971 | Atkinson | 15/340 X |
| 3,665,545 | 5/1972 | Beekman | 15/340 X |
| 3,717,901 | 2/1973 | Johnstone | 15/340 X |
| 3,847,293 | 11/1974 | Boon | 15/340 X |
| 3,902,219 | 9/1975 | Jones | 15/340 X |

*Primary Examiner*—Christopher K. Moore

*Attorney, Agent, or Firm*—Vogel, Dithmar, Stotland, Stratman & Levy

[57] ABSTRACT

A system for cleaning large areas such as baseball parks and football stadiums and picnic areas and zoos, including a truck having a chassis, a refuse compactor mounted on the chassis for packing refuse into a small volume therein, a blower mounted on said chassis and constructed and arranged to draw air and entrained refuse into an inlet for the blower and to blow the refuse from the blower into the compactor, a substantial length of flexible hose having one end thereof connected to the inlet to the blower and a pickup nozzle connected to the other end of said hose, the pickup nozzle having an inlet end with an opening therein substantially greater in area than the internal area of the hose, the blower creating a stream of air entering the inlet end of the nozzle and carrying refuse therewith and along the hose and through the blower and into the compactor thereby rapidly to clean refuse from large areas and to compact the refuse into a small volume in the compactor.

7 Claims, 8 Drawing Figures

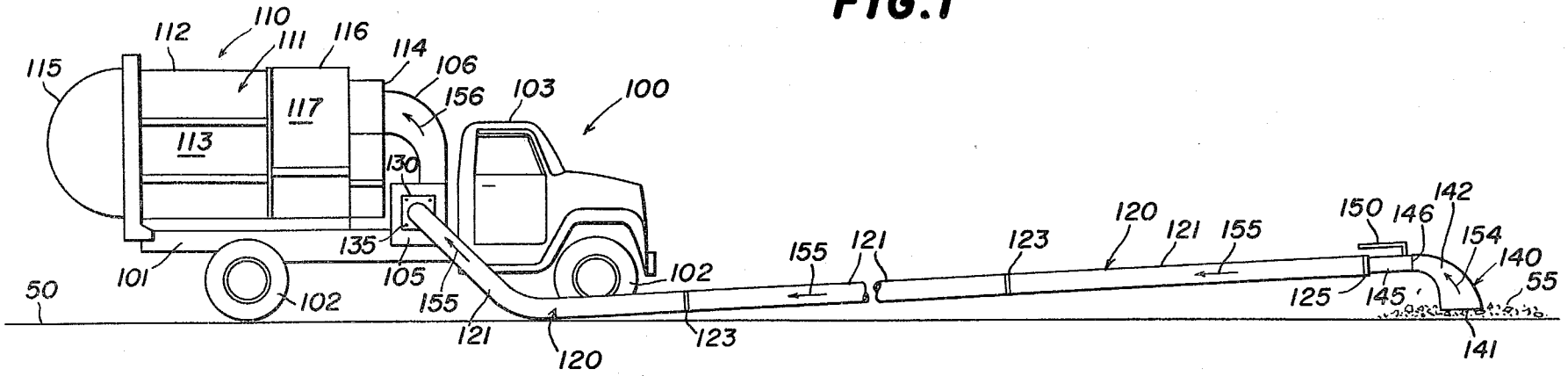
FIG. 1
100
101
102
103
105
106
110
111
112
113
114
115
116
117
120
121
123
125
130
135
140
141
142
145
146
150
154
155
156
50
55
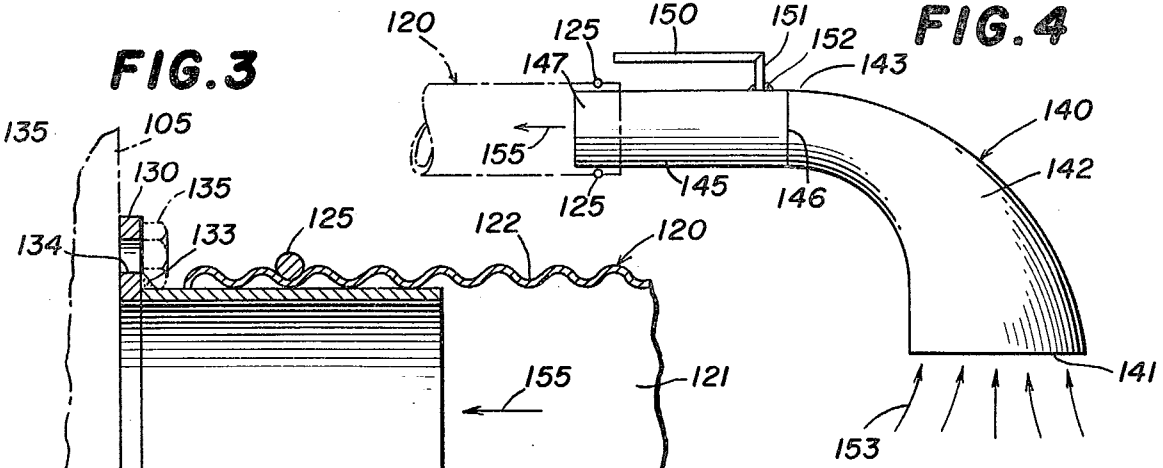
FIG. 4
120
121
122
125
132
133
134
135
140
141
142
143
145
146
147
150
151
152
153
155
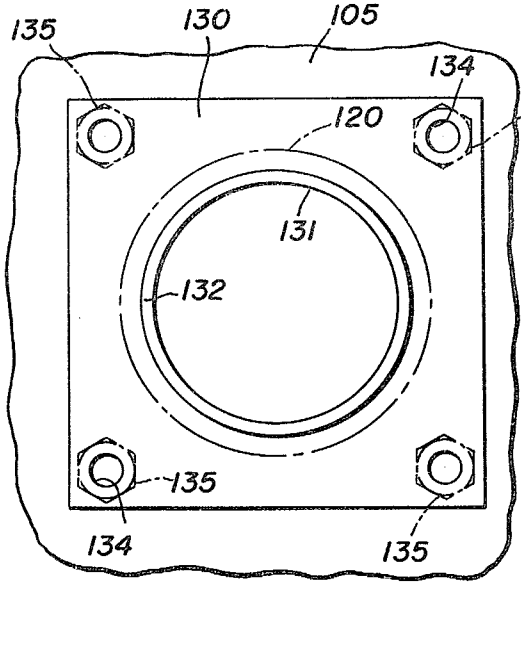
FIG. 3
105
130
131
132
133
134
135
FIG. 2
105
120
130
131
132
134
135

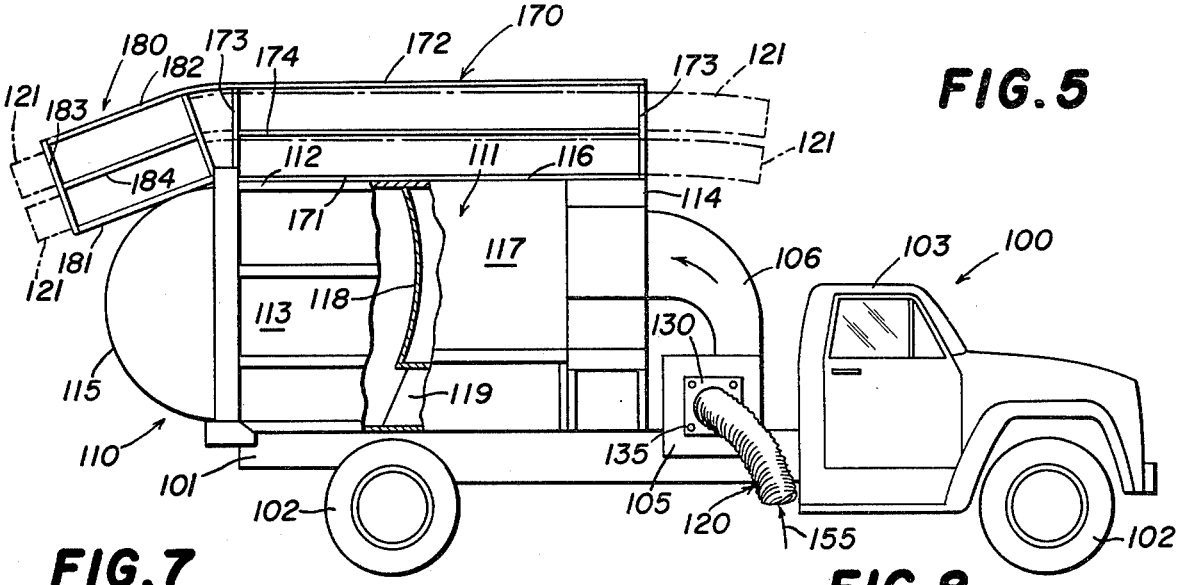
FIG. 5
FIG. 7
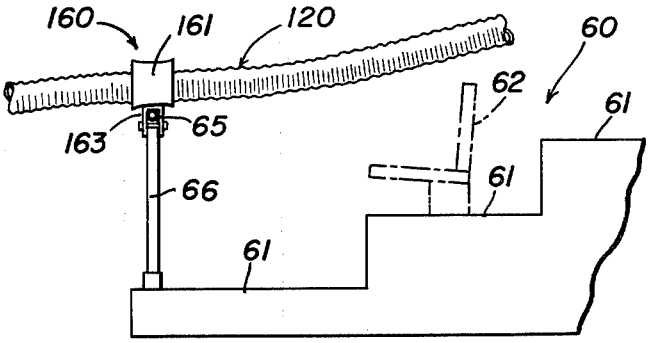
FIG. 8
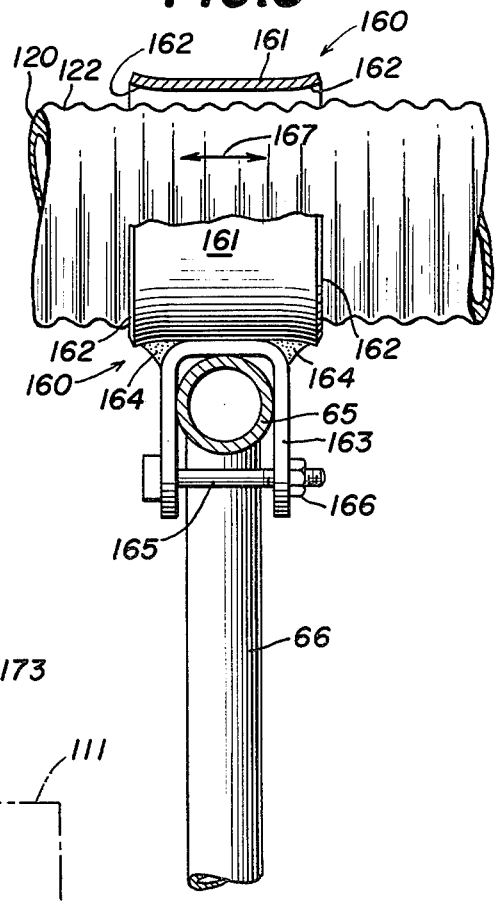
FIG. 6
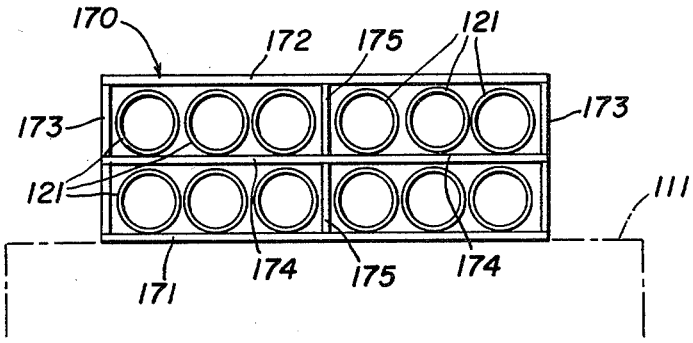

LARGE AREA CLEANING SYSTEM

BACKGROUND OF THE INVENTION AND PRIOR ART STATEMENT

The present invention relates generally to cleaning systems, and particularly to cleaning systems useful to clean large areas, such as baseball parks, football stadiums, picnic areas and zoos.

Standard practice heretofore in cleaning large areas such as baseball parks, football stadiums, picnic areas and zoos, has been to collect the refuse manually using rakes and brooms and eventually to place the refuse in receptacles for disposal. Attempts to automate the cleaning of large areas are exemplified by the following patents and article:

| U.S. Patents | | |
|---|---|---|
| Pat. No. | Inventor | Date |
| 2,471,326 | W. C. Hoyt, Sr. | May 24, 1949 |
| 2,850,162 | E. Widmer | Sept. 2, 1958 |
| 3,404,776 | R. E. Shaddock | Oct. 8, 1968 |
| 3,802,585 | H. W. Churchman | April 9, 1974 |

Foreign Patents

British Pat. No. 852,853 published Nov. 2, 1960.

Italian Pat. No. 428,203 (with partial translation) granted Dec. 9, 1947.

Advertising Literature

Helix Product Data Bulletin No. 5101

The Hoyt Pat. No. 2,471,326 and the Helix Product Data Bulletin No. 5101 illustrate past devices useful in collecting leaves. Neither of these systems would be useful for collecting refuse from large areas such as baseball parks and the like since the hoses associated therewith are of limited extent. It is pointed out that the details of the compactor forming a part of the Helix leaf loader of Product Data Bulletin No. 5101 are illustrated in the Churchman Pat. No. 3,802,585.

The Widmer Pat. No. 2,850,162 shows a stationary system for collecting refuse, but there is no suggestion of applying this system in a mobile manner to clean large areas. To the same effect is the Italian Pat. No. 428,203.

Finally, the Shaddock Pat. No. 3,404,776 and the British Pat. No. 852,853 show portable systems for vacuum collecting of refuse, fundamentally from streets and the like. Neither of these systems though would be particularly useful in cleaning large areas in view of the limited extent of the hoses used to pick up the refuse.

SUMMARY OF THE INVENTION

The present invention provides an improved system for cleaning large areas such as baseball parks, football stadiums, picnic areas and zoos, and particularly utilizing long distance pickup of the refuse for conveying to a central collection point.

This is accomplished in the present invention, and it is an object of the present invention to accomplish these desired results, by providing a system for cleaning large areas including a portable chassis, a refuse compactor mounted on the chassis for packing refuse into a small volume therein, a blower mounted on the chassis and constructed and arranged to draw air and entrained refuse into an inlet for the blower and to blow the refuse from the blower into the compactor, a substantial length of flexible hose having one end thereof connected to the inlet to the blower and a pickup nozzle connected to the other end of the hose, the pickup nozzle having an inlet end with an opening therein substantially greater in area than the internal area of the hose, the blower creating a stream of air entering the inlet end of the nozzle and carrying refuse therewith and along the hose and through the blower and into the compactor thereby rapidly to clean refuse from large areas and to compact the refuse into a small volume in the compactor.

Another object of the invention is to provide in a system of the type set forth, a blower that shreds the refuse into pieces having a maximum dimension in the range from about two inches to about three inches with the compactor reducing the volume of the shredded refuse in the ratio of about 20 to 1.

Still another object of the invention is to provide a system of the type set forth wherein the substantial length of flexible hose has a length in the range from about 100 feet to about 400 feet or more and has an internal diameter in the range from about eight inches to about twelve inches, the flexible hose being formed of a lightweight molded plastic having a wall thickness of about one-sixteenth inch and being annularly corrugated to facilitate the bending and handling thereof.

Yet another object of the invention is to provide in a system of the type set forth a flexible hose formed in sections having lengths of about 20 feet, and further including hose clamps interconnecting adjacent hose sections and a hose clamp connecting one end of one of the hose sections to the inlet of the blower and another hose clamp connecting one end of another hose section to the pickup nozzle.

Still another object of the invention is to provide in a system of the type set forth a pickup nozzle wherein the plane defined by the inlet end thereof is disposed essentially parallel to the axis of the hose to which the nozzle is connected, and the area of the opening in the inlet end of the nozzle has a ratio to the area of the inlet end of the hose in the range from about 1.5 to 3.

Yet another object of the invention is to provide in a large area cleaning system of the type set forth a hose rack mounted on the chassis for carrying sections of hose therein.

A further object of the invention is to provide in a large area cleaning system of the type set forth a hose support member including a sleeve for slidingly receiving a hose therethrough, and a clamp for mounting the sleeve on the railing of an upper deck in a stadium or a ballpark to support the hose in an elevated position during the cleaning of the upper deck.

Further features of the invention pertain to the particular arrangement of the parts of the cleaning system, whereby the above outlined and additional operating features thereof are attained.

The invention, both as to its organization and method of operation, together with further features and advantages thereof will best be understood with reference to the following specification taken in connection with the accompanying drawings.

BRIEF DESCRIPTION OF THE DRAWINGS

FIG. 1 is a side elevational view of a large area cleaning system made in accordance with and embodying the principles of the present invention;

FIG. 2 is a side elevational view on an enlarged scale of the attachment plate used to interconnect the suction hose to the fan unit;

FIG. 3 is a view in longitudinal section through the attachment plate of FIG. 2 and the associated connected section of the suction hose;

FIG. 4 is an enlarged view of the pickup nozzle forming a part of the system of FIG. 1;

FIG. 5 is an enlarged view of the truck forming a part of the system of FIG. 1 with certain portions broken away to illustrate details of the compactor, and further illustrating a rack carried thereon to support sections of hose;

FIG. 6 is an end view of the hose carrying rack of FIG. 5;

FIG. 7 is a side elevational view showing a support for the hose on a balcony or upper deck in a baseball park or football stadium; and FIG. 8 is an enlarged view with certain portions broken away of the hose support member illustrated in FIG. 7.

DESCRIPTION OF THE PREFERRED EMBODIMENTS

There is illustrated in FIG. 1 of the drawings a system for cleaning large areas such as baseball parks, football stadiums outdoor picnic areas, zoos and the like, comprising a truck 100 carrying a fan unit 105 and a compactor 110, a long flexible hose 120 having one end connected to the inlet of the fan unit 105 and carrying at the other end thereof a pickup nozzle 140, all made in accordance with and embodying the principles of the present invention.

The truck 100 includes the usual chassis 101 supported by four wheels 102 and carrying a cab 103 with the usual controls therein. The fan unit 105 is mounted directly behind the cab 103 and is connected by a duct 106 to the inlet to the compactor 110. The compactor 110 includes a generally rectangular housing 111 having a top wall 112, a pair of essentially parallel side walls 113, a front wall 114, and a hinged door 115 closing the rear of the housing 111. The duct 106 connects with an opening in the front wall 114 and blows refuse into a loading area 116 in the compactor 110. A side door 117 is provided for the loading area 116 for manual loading if required. Referring also to FIG. 5, there is shown diagrammatically an ejection blade assembly 118 and a packing blade 119. Further details of the construction and operation of the compactor 110 are set forth in the Churchman Pat. No. 3,802,585, and the disclosure thereof is incorporated herein by reference. Details of the fan unit 105 and the duct 106 are also set forth in the Helix Product Data Bulletin No. 5101 referred to above, and the disclosure thereof is incorporated herein by reference.

The flexible hose 120 is preferably formed of a plurality of sections 121. Each of the sections 121 has a length of 20 feet and may have a diameter of eight inches or ten inches or twelve inches, and in fact a diameter in the range from about eight inches to about twelve inches. The hose sections 121 are preferably formed of a resilient plastic having a thickness of about one-sixteenth inch and are provided with annular corrugations 122 (see FIG. 3 also). The lightweight molded plastic construction together with the corrugations 122 provide for ease of handling of the hose 120 even at lengths thereof as great as 400 feet. In addition, the hose can be folded and bent without breaking, even at operating temperatures as low as 40° F. below zero. The interior surfaces of the hose 120 are smooth and are readily cleaned prior to storage.

Adjacent sections 121 of the hose 120 are connected by split plastic couplers 123, the number of sections 121 being selected to provide the required overall length of the flexible hose 120. One end of the assembled hose 120 is connected to the fan unit 105 by means of an attachment plate 130 (see FIGS. 2 and 3). The fan unit 105 has an opening therein around which is disposed an essentially square attachment plate 130 having an aperture 131 in the center thereof registering with the opening into the fan unit 105. Surrounding the aperture 131 is an annular flange 132 that is welded to the plate 130 as at 133, the flange 132 extending outwardly and to the right as viewed in FIG. 3 for receiving the end of an adjacent hose section 121 thereon. An opening 134 is provided in each of the corners of the plate 130, each opening 134 receiving a bolt 135 therethrough, the bolts 135 cooperating to secure the attachment plate 130 to the fan unit 105. The adjacent end of the associated hose section 121 is secured to the flange 132 by means of a hose clamp 125.

The other end of the assembled hose 120 carries thereon the pickup nozzle 140, the details of construction of which are best illustrated in FIGS. 1 and 4. The pickup nozzle 140 includes an inlet end 141 that is disposed in a plane and has a generally circular opening therein that has a diameter of, for example, twenty inches. The nozzle 140 extends upwardly from the inlet end in a generally conical fashion and joins a transition section 142 which is of decreasing area in the direction away from the inlet end 141 and ends in a connection end 143 that is generally circular in shape and defines a plane that is normal to the plane defined by the inlet end 141. The external diameter of the connection end 143 is essentially equal to that of an associated connector pipe 145 that is secured thereto as by a weld 146. The connector pipe 145 has a free end 147 that is also essentially circular in shape and has an external diameter essentially equal to the internal diameter of the associated suction hose 120, i.e., a diameter in the range from about eight to twelve inches, and, for example, may be eight inches or ten inches or twelve inches in diameter. The adjacent end of the hose 120 is secured to the connector pipe 145 by a hose clamp 125 like the hose clamp 125 that secures the other end of the hose 120 to the attachment plate 130. There is secured to the connector pipe 145 a handle 150 that includes a right angle connecting portion 151 secured as by welding 152 to the connector pipe 145. The longitudinal axis of the handle 150 is parallel to the longitudinal axis of the connector pipe 145 and is spaced from the adjacent surface thereof to accommodate the hand of a user. Preferably the handle 150 is covered with a rubber or plastic grip for greater ease of operator convenience in cold and wet weather.

An example of a typical use of the large area cleaning system of the present invention is to clean up a football stadium after a professional football game. In a typical example of such a use, the system of the present invention was utilized to clean Soldier's Field at Chicago, Ill. after a professional football game attended by 57,000 people. After the game was completed and the spectators had departed, the truck 100 was driven onto the playing surface adjacent to one edge thereof with the attachment plate 130 disposed toward the stands. Workmen using brooms and rakes moved the refuse into windrows in the usual manner. The hose sections 120 were assembled, one end attached to the attachment plate 130 and the other end to the pickup nozzle 140. Using a substantial length of hose 120, the nozzle 140 was utilized to pick up the refuse from the windrows. The refuse typically included broken watermelons and other fruit and debris, fabric blankets, plastic and metal containers from a six ounce size up to a five gallon size, and general paper and cardboard refuse.

Collection of refuse was initiated by starting the fan unit 105 which generated a movement of air through the hose 120. The fan unit 105 is constructed and arranged so as to produce 10,000 linear feet of air movement per minute, this providing 9600 cubic feet of air movement per minute through a twelve inch diameter opening at the fan unit 105 under normal working conditions in accordance with the Air Moving And Conditioning Association Standards. 400 feet of hose 120 were coupled so as to be able to reach from the playing surface up to the farthest reach of the stands adjacent thereto. With the truck located in one position, a sector of the playing field and the adjacent viewing stands was cleared of debris. A stream of air was generated in the direction of the arrows 153 (see FIG. 4) entering the inlet end 141 of the pickup nozzle 140 and continuing in the direction of the arrows 154 (see FIG. 1) and 155 and into the fan unit 105.

The fan unit 105 includes a six-bladed fan which serves to shred the refuse into particles having a maximum diameter in the range from about two inches to about three inches. The stream of air with the entrained shredded refuse passes upwardly through the duct 106 and into the compactor 110. The compactor 110 is operated as described in Pat. No. 3,802,585 referred to above. More specifically (and referring to FIG. 5), the packing blade 119 oscillates in a horizontal manner and serves to pack refuse falling in front thereof into the upper space and against the ejection blade assembly 118. In the particular cleaning operation at Soldier's Field, the debris filled the compactor to about one-fourth of the capacity thereof, the ratio between the volume of the shredded refuse before compaction and after compaction being about 20 to 1.

After the first sector has been cleaned of refuse as described above, the truck 100 is moved to the next sector. This next sector is then cleaned both on the playing field and in the associated portion of the viewing stand. This process was continued until the entire playing surface and the associated stands had been cleaned of all refuse. This required about two hours and twenty minutes of elapsed time to clean Soldier's Field after a football game attended by 57,000 people. The truck 100 was then driven to a place of disposal, the rear door 115 opened upwardly, and the ejection blade assembly 118 and the packing blade 119 moved rearwardly simultaneously to eject the packed refuse therefrom.

During the cleaning operation in the stadium, it was found that the nozzle 140 was easily handled and could pick up all manner and types of debris as described above. Also the inlet end 141 of the nozzle was sufficiently small to get into restricted areas, yet was large enough to accept debris of large dimensions for transmission through the hose 120 and into the fan unit 105. The pickup nozzle 140 and the length of hose 120 was sufficiently light in construction that a single individual could operate and manipulate the same, whereby if needed, the entire refuse collecting operation could be accomplished by using a single operator.

Other compactors may be used in pace of the compactor 110 illustrated in Helix Product Data Bulletin No. 5101, and manufactured by the Prefection-Cobey Co., Division of Harsco Corp. For example, other suitable compactors are manufactured by Peabody Galion Corporation and PakMor, Inc. It is only necessary that the compactor has a size and shape such that it can enter into the baseball park or football stadium or other large area that is to be cleaned. All of the parts described herein are preferably formed of metal, except for those that have been designated as being formed of plastic.

There is illustrated in FIGS. 5 and 6 of the drawings a hose rack 170 that can be mounted on the truck 100, and specifically on top of the compactor 110 for holding a plurality of the sections 121 used in forming the elongated hose 120. The rack 170 is preferably formed of an angle iron framework using nuts and bolts. More specifically, there are provided bottom members 171 and top members 172 joined by side members 173 to provide an essentially rectangular array. Disposed between the bottom members 171 and the top members 172 are intermediate members 174, and disposed between the side members 173 are divider members 175. The various members mentioned cooperate to provide receptacles that each receive three of the hose sections 121. The members 171 through 175 extend rearwardly to the hinged door 115, and extending downwardly and rearwardly therefrom is a rear portion 180 including bottom members and top members 182 joined by side members 183 and having intermediate members 184 disposed therebetween. The rear portion 180 forms a rearward and downward continuation of the rack 170 as is best illustrated in FIG. 5. As illustrated, the rack 170 can accommodate twelve 20 foot sections 121 that can be connected to form a 240 foot suction hose 120.

In certain baseball parks and football stadiums, there is not only a lower or bottom tier to the seating arrangement, but there also are balconies or upper decks or upper tiers, sometimes two or more of such upper tiers being provided.

It is desirable to be able to clean such upper tiers using the system of the present invention, and all while the truck 100 is positioned upon the playing surface or adjacent to the playing surface at what is essentially ground level. There is illustrated in FIGS. 7 and 8 of the drawings a hose support member that is adapted to be mounted upon the rail of an upper tier designated by the numeral 60 in FIG. 7. The upper tier 60 includes stepped support surfaces 61 that support chairs 62, the forward portion of the upper tier 60 being provided with a protective rail 65. The rail 65 is arranged essentially horizontally and is supported by a series of spaced posts 66 that extend upwardly from the forwardmost support surface 61. In accordance with the present invention, a hose support member 160 is removably secured to the rail 65 to support an intermediate portion of the suction hose 120 while the associated upper tier 60 is being cleaned.

The hose support member 160 includes an elongated sleeve 161 which has the outer ends flared outwardly as at 162, the internal diameter of the sleeve 161 accepting the hose 120 therethrough and accommodating sliding movement thereof as is diagrammatically illustrated by the arrow 167. Fixedly secured to the sleeve 160 is a U-clamp 163 attached as by welding 164 to the sleeve 161. The legs of U-clamp 163 straddle the rail 65 and the outer ends of the legs of the U-clamp 163 receive a bolt 165 therethrough that carries on its upper threaded end a nut 166. Tightening of the nut 166 upon the bolt 165 serves to clamp the U-clamp 163 and the attached sleeve 161 in the desired operative position upon the rail 65. After cleaning of the associated section of the upper tier 60, the hose support member 160 can be moved to the next section of the upper tier 60 for supporting the hose 120 during the cleaning of the refuse therefrom.

While there have been described what are at present considered to be the preferred embodiments of the invention, it will be understood that various modifications may be made therein, and it is intended to cover in the appended claims all such modifications as fall within the true spirit and scope of the invention.

What is claimed is:

1. A system for cleaning large areas such as baseball parks and football stadiums and picnic areas and zoos, comprising a portable chassis, a refuse compactor mounted on said chassis for packing refuse into a small volume therein, a blower mounted on said chassis and constructed and arranged to draw air and entrained refuse into an inlet for said blower and to blow the refuse from said blower into said compactor, a substantial length of flexible hose having one end thereof connected to the inlet to said blower and a pickup nozzle connected to the other end of said hose, said pickup nozzle having an inlet end with an opening therein substantially greater in area than the internal area of said hose, said blower creating a stream of air entering the inlet end of said nozzle and carrying refuse therewith and along said hose and through said blower and into said compactor thereby rapidly to clean refuse from large areas and to compact the refuse into a small volume in said compactor, a hose support member including a sleeve for supporting and receiving said hose therethrough for sliding motion with respect thereto, and a clamp for mounting said sleeve upon the railing of an upper deck to assist in holding said hose during cleaning of the upper deck.

2. The improvement in a system for cleaning large areas set forth in claim 1, wherein said substantial length of flexible hose has a length in the range from about 100 feet to about 400 feet or more and has an internal diameter in the range from about eight inches to about twelve inches.

3. The improvement in the system for cleaning large areas set forth in claim 1, wherein said flexible hose is formed of a lightweight molded plastic having a wall thickness of about one-sixteenth inch and being annularly corrugated to facilitate the bending and handling thereof.

4. The improvement in the system for cleaning large areas set forth in claim 1, wherein said flexible hose is provided in sections having lengths of about 20 feet, and further including hose clamps interconnecting adjacent hose sections and a hose clamp connecting one end of one of the hose sections to the inlet for the blower and another hose clamp connecting one end of another hose section to said pickup nozzle.

5. The improvement in the system for cleaning large areas set forth in claim 1, wherein the plane defined by the inlet end of said nozzle is disposed essentially parallel to the axis of the hose to which said nozzle is connected.

6. The improvement in the system for cleaning large areas set forth in claim 1, wherein the area in the opening in the inlet end of said nozzle has a ratio to the area of the inlet end to said hose in the range from about 1.5 to 3.

7. The improvement in the system for cleaning large areas set forth in claim 1, wherein said pickup nozzle has a handle thereon to facilitate movement in handling thereof during the cleaning operation.

* * * * *